US010320091B2

(12) United States Patent
Yamashita et al.

(10) Patent No.: US 10,320,091 B2
(45) Date of Patent: Jun. 11, 2019

(54) ARRAY ANTENNA FOR SATELLITE COMMUNICATIONS AND ANTENNA

(71) Applicant: Mitsubishi Electric Corporation, Chiyoda-ku (JP)

(72) Inventors: Kazuyoshi Yamashita, Chiyoda-ku (JP); Tomohiro Takahashi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 66 days.

(21) Appl. No.: 14/726,818

(22) Filed: Jun. 1, 2015

(65) Prior Publication Data

US 2015/0349434 A1 Dec. 3, 2015

(30) Foreign Application Priority Data

Jun. 3, 2014 (JP) ..... 2014-114983
May 26, 2015 (JP) ..... 2015-106054

(51) Int. Cl.
*H01Q 21/00* (2006.01)
*H01Q 21/06* (2006.01)

(52) U.S. Cl.
CPC ..... *H01Q 21/065* (2013.01); *H01Q 21/0025* (2013.01)

(58) Field of Classification Search
CPC ..... H01Q 21/065; H01Q 21/0006; H01Q 21/0025
See application file for complete search history.

(56) References Cited

U.S. PATENT DOCUMENTS

2004/0051667 A1 3/2004 Ro et al.
2005/0128148 A1* 6/2005 Anguera Pros ..... H01Q 1/36 343/700 MS
2015/0084832 A1* 3/2015 Ai ..... H01Q 1/246 343/893

FOREIGN PATENT DOCUMENTS

JP 6-132717 5/1994
JP 9-214241 8/1997
JP 2005303801 * 10/2005

OTHER PUBLICATIONS

Japanese Office Action dated Jun. 19, 2018 in Japanese Application No. 2015-106054 (with English Translation), 5 pages.

* cited by examiner

*Primary Examiner* — Robert Karacsony
(74) *Attorney, Agent, or Firm* — Oblon, McClelland, Maier & Neustadt, L.L.P.

(57) ABSTRACT

An array antenna for satellite communications includes a first sub-array and a second sub-array, each including a plurality of antenna elements arrayed in a matrix with a regular pitch, the first sub-array and the second sub-array being shifted relative to each other in a satellite orbital direction.

6 Claims, 7 Drawing Sheets

ARRAY ANTENNA FOR SATELLITE COMMUNICATIONS AND ANTENNA

CROSS-REFERENCE TO RELATED APPLICATION

This application claims the benefit of Japanese Patent Application No. 2014-114983, filed on Jun. 3, 2014, and Japanese Patent Application No. 2015-106054, filed on May 26, 2015, the entire disclosures of which are incorporated by reference herein.

FIELD

This application relates to an array antenna for satellite communications and an antenna, each including two-dimensionally arrayed antenna elements.

BACKGROUND

In general in array antennas for satellite communications, a side-lobe level indicating the relative level, that is, relative signal strength, of a side lobe with respect to the main lobe is required to be low so as not to cause radio interference between satellite communication systems. Patent Literature 1 (Unexamined Japanese Patent Application Kokai Publication No. H9-214241) discloses an array antenna in which sub-arrays, each constituted by a plurality of antenna elements, are arrayed densely in a satellite orbital direction so that the side-lobe level is low.

SUMMARY

In the array antenna disclosed in Patent Literature 1, some power-supply lines, each being from a power-supply part to a respective antenna element, are required to be routed with redundant windings so as to equalize the line length among all of the power-supply lines, to align excitation phases. Thus, power-supply loss may be high.

The present disclosure is made in consideration of such circumstances, and an objective of the present disclosure is to provide an array antenna for satellite communications and an antenna, in which the side-lobe level and power-supply loss are low.

An array antenna for satellite communications according to the present disclosure includes a first sub-array and a second sub-array, each including antenna elements arrayed in a matrix with a regular pitch, the first sub-array and the second sub-array being shifted relative to each other in a satellite orbital direction.

Furthermore, an antenna according to the present disclosure includes a substrate, a first sub-array comprising a plurality of antenna elements arrayed in a matrix on the substrate, and a second sub-array comprising a plurality of antenna elements arrayed in a matrix on the substrate, the first sub-array and the second sub-array being arranged to be adjacent to each other in the short-side direction and to be shifted relative to each other in a long-side direction.

According to the present disclosure, an array antenna for satellite communications and an antenna, in which the side-lobe level and power-supply loss are low, can be provided.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

An array antenna for satellite communications according to Embodiment 1 of the present disclosure is described below, with reference to FIGS. 1 to 4.

Figure 1:
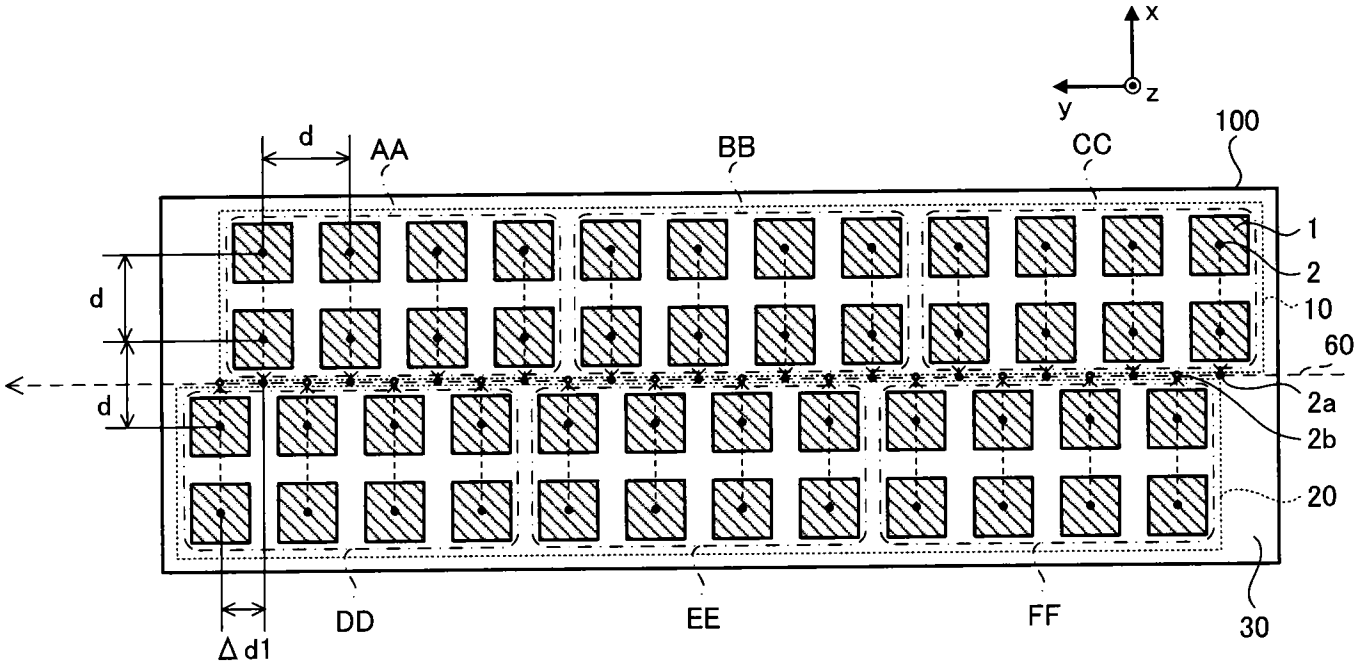
FIG. 1 is a diagram illustrating an arrangement of sub-arrays of an array antenna for satellite communications according to Embodiment 1 of the present disclosure.

FIG. 1 is a diagram illustrating an arrangement of sub-arrays of an array antenna for satellite communications according to Embodiment 1 of the present disclosure. As shown in FIG. 1, an array antenna for satellite communications 100 (hereinafter referred to as "array antenna 100") according to Embodiment 1 of the present disclosure includes an insulating substrate 30 and antenna elements 1 disposed on a main surface of the insulating substrate 30. To facilitate distinguishing between the antenna elements 1 and the insulating substrate 30, the antenna elements 1 are hatched.

To facilitate understanding, an xyz orthogonal coordinate system is used. In FIG. 1, the short-side direction of the main surface of the array antenna 100 is defined as an x-axis direction, and the long-side direction of the main surface of the array antenna 100, that is, a direction orthogonal to the x-axis direction, is defined as a y-axis direction. Also, a direction orthogonal to each of the x and y axes is defined as a z-axis direction. While the array antenna 100 communicates with a satellite using the array antenna 100, the main surface of the array antenna 100 is directed to the satellite. That is, the z-axis direction that is the normal direction of the main surface of the array antenna 100 is directed to the satellite. And, the y-axis direction of the main surface of the array antenna 100 is arranged so that the satellite orbital plane of a satellite for communication with the array antenna 100 is parallel to the yz plane that includes the y and z axes. A satellite orbital direction 60 is parallel to the intersection line of the satellite orbital plane and the main surface of the array antenna 100, and is parallel to the y-axis direction.

As shown in FIG. 1, the array antenna 100 includes a first sub-array 10 and a second sub-array 20, each including antenna elements 1 arrayed in a matrix of m rows and n columns, with a regular pitch d. In other words, the first sub-array 10 and the second sub-array 20 each include antenna elements 1 arrayed in two rows and 12 columns, with the pitch d. The row direction and the column direction of the matrix of the antenna elements 1 are set to be in the y-direction, that is, the long-side direction and the x-direction, that is, the short-side direction, respectively. The pitch d is a distance between phase centers 2 of adjacent antenna elements 1.

The first sub-array 10 and the second sub-array 20 are arranged to be adjacent to each other in the x-axis direction, that is, a direction orthogonal to the satellite orbital direction 60, and to be shifted relative to each other in the y-axis direction, that is, the long-side direction, by one half of the pitch d. Arranging sub-arrays so that positions of sub-arrays are shifted relative to each other in a direction can also be said that sub-arrays are arranged with an offset in the direction. An interval Δd1 between a projection point 2*a*, obtained when projecting the phase center 2 of each antenna element 1 included in the first sub-array 10 perpendicularly onto the satellite orbital plane, and projection point 2*b*, obtained when projecting the phase center 2 of each antenna element 1 included in the second sub-array 20 perpendicularly onto the satellite orbital plane, is equal to the positional difference between the first sub-array 10 and the second sub-array 20, that is, one half of the pitch d. The positional difference, that is, an intended position-shifting can also be said as an offset.

Figure 2:
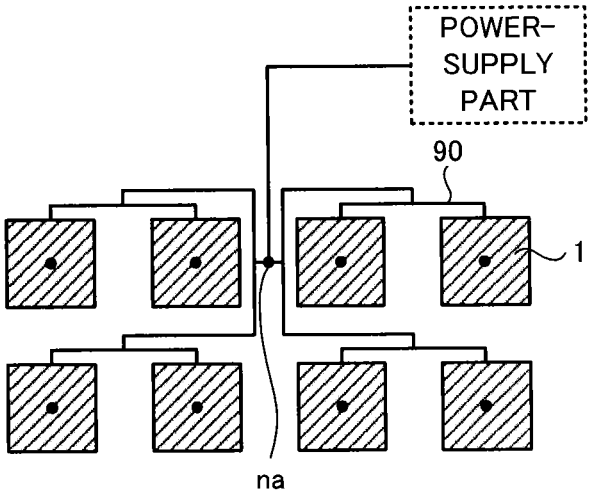
FIG. 2 is a diagram illustrating a coupling state of power-supply lines for antenna elements in a section AA shown in FIG. 1.

FIG. 2 is a diagram illustrating a coupling state of power-supply lines for antenna elements 1 in a section AA shown in FIG. 1. As shown in FIG. 2, the antenna elements 1 arrayed in a matrix in the section AA are each coupled via the same length of power-supply line 90 to a branch point na, from which each power-supply line 90 extends. This configuration also applies to the sections BB through FF shown in FIG. 1. The respective branch points na provided in the sections AA through FF are coupled to the same power-supply part via the same length of respective power-supply lines 90. Hence, in the sections AA through FF, the same length of power-supply line 90 is used to couple the power-supply part to each antenna element, without forming a redundant wiring.

Figure 3A:
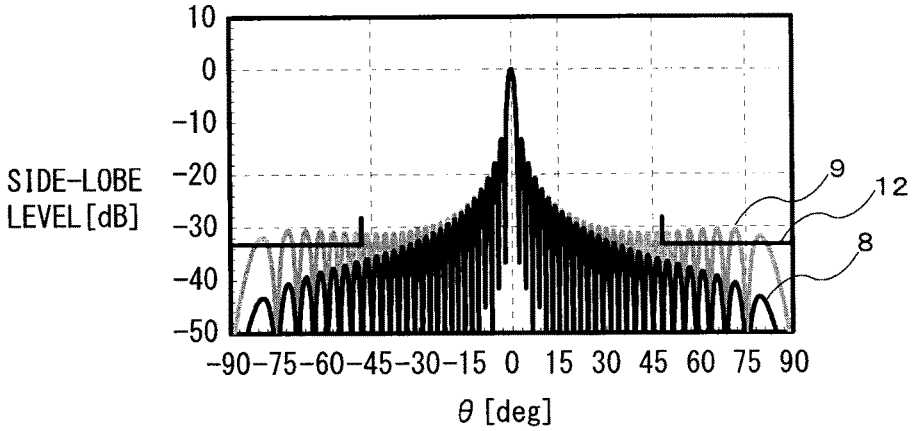
FIG. 3A is a diagram illustrating a radiation pattern of the array antenna for satellite communications according to Embodiment 1.
Figure 3B:
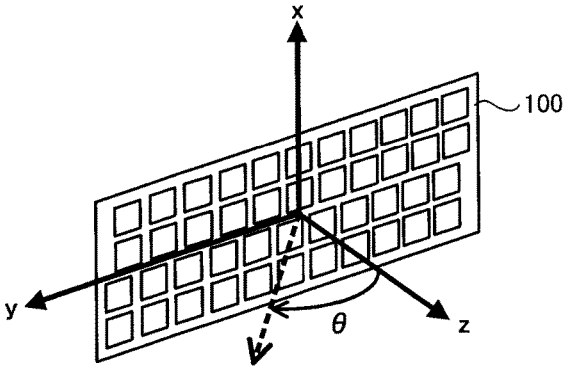
FIG. 3B is an explanatory diagram of an angle θ shown in FIG. 3A.

With reference to FIGS. 3A and 3B, the side-lobe level of the array antenna 100 are described below. The horizontal axis of FIG. 3A indicates an angle θ [deg] between the boresight direction of the array antenna 100, that is, the z-axis direction, which is used as a reference direction, and an observation direction in the yz plane and, as shown in FIG. 3B. The vertical axis of FIG. 3A indicates the side-lobe level [dB] at each angle θ, using the main lobe at the θ angle of 0 as a reference level. A radiation pattern 8 indicates a radiation pattern of the array antenna 100. A radiation pattern 9 indicates a radiation pattern of an array antenna for satellite communications including two sub-arrays that are not shifted in the satellite orbital direction 60. A standard value example 12 indicates an acceptable side-lobe level defined by recommendations by the International Telecommunication Union Radiocommunications Sector (ITU-R) or the like. The standard value example 12 is set to be −34 dB or less in angle ranges of −90 to −48 [deg] and of 48 to 90 [deg].

As shown in FIG. 3A, the radiation pattern 9 of the array antenna for satellite communications including two sub-arrays that are not shifted, that is, without an offset in the satellite orbital direction 60, exceeds the standard value example 12. In contrast, the radiation pattern 8 of the array antenna 100 having a structure in which two sub-arrays are shifted, that is, with an offset in the satellite orbital direction 60, falls below the standard value example 12. Thus, the array antenna 100 generates a lower level of side lobes in the satellite orbital plane than an array antenna including two sub-arrays that are not shifted in the satellite orbital direction 60 does.

Figure 4:
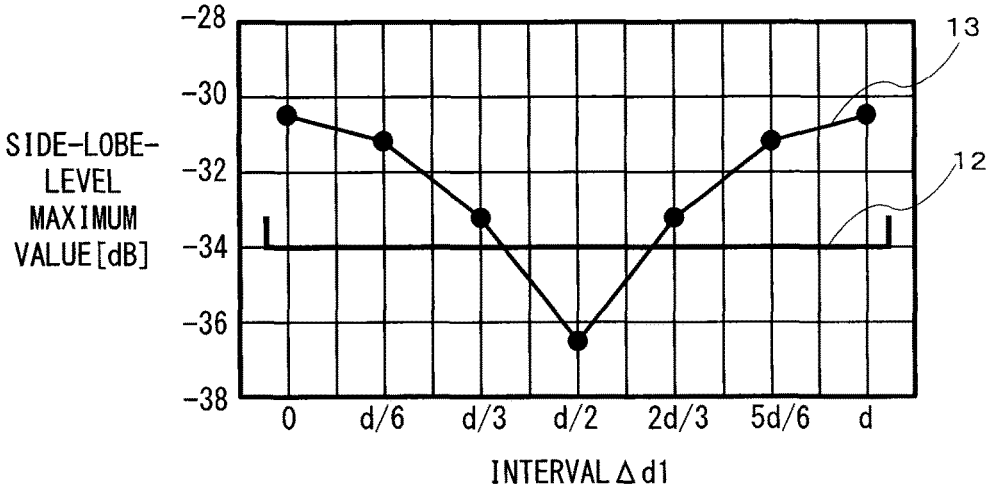
FIG. 4 is a diagram illustrating a relationship between an interval and a side-lobe-level maximum value, the interval being between a phase center of each antenna element included in a first sub-array and a phase center of each antenna element included in a second sub-array.

With reference to FIG. 4, the relationship between the interval Δd1 and the side lobes is described below. FIG. 4 is a diagram illustrating the relationship between the interval Δd1 and a side-lobe-level maximum value 13. The side-lobe-level maximum value 13 indicated in FIG. 4 is a maximum value of side lobes in the angle ranges of −90 to −48 [deg] and of 48 to 90 [deg], for which the standard value example 12 is set in FIG. 3A.

As shown in FIG. 4, the side-lobe-level maximum value 13 is greatest when the interval Δd1 is zero or d. In contrast, the side-lobe-level maximum value 13 is least when the interval Δd1 is one half of d. Hence, when the interval Δd1 is one half of the pitch d, the side-lobe level in the satellite orbital plane is lowest.

The array antenna 100 is designed such that the interval Δd1 is equal to the positional difference, that is, the offset between the two sub-arrays and is one half of the pitch d, and thus the side-lobe level in the satellite orbital plane is extremely low.

According to the array antenna 100 of Embodiment 1 as described above, the two sub-arrays, each including antenna elements 1 arrayed in a matrix, are shifted relative to each other in the satellite orbital direction 60. This arrangement enables an extremely low side-lobe level in the satellite orbital plane. Furthermore, because the antenna elements 1 are arrayed in a matrix, the same length of power-supply line 90 can be used for each antenna element 1 without routing any power-supply line in a winding manner for adjustment of the line length. Thus, power-supply loss is low.

Furthermore, the array antenna 100 according to Embodiment 1 is designed such that the positional difference between the two sub-arrays is one half of the pitch d, and thus the side-lobe level in the satellite orbital plane is extremely low.

In the foregoing present embodiment, the shape of each antenna element 1 is a square as shown in FIG. 1, by way of an example. However, any shape may be employed. The shape of each antenna element 1 may be, for example, a rectangle, a circle, an ellipse, a triangle, or the like.

Figure 5:
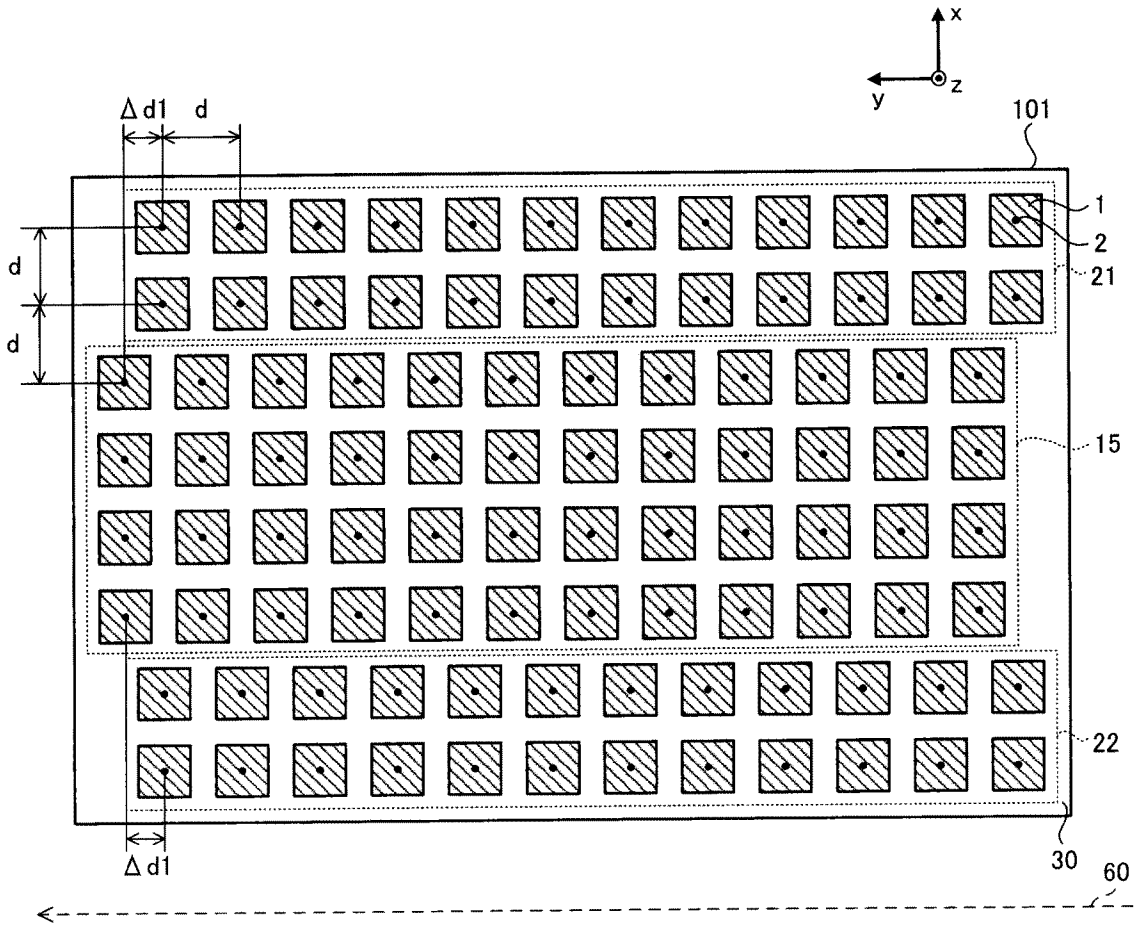
FIG. 5 is a diagram illustrating a modification of the array antenna for satellite communications according to Embodiment 1.

Furthermore, in the present embodiment, the sub-arrays, each having antenna elements 1 arrayed in a matrix of m rows and n columns, are arranged in two rows as shown in FIG. 1. This disclosure is not limited to this arrangement, and such sub-arrays may be arranged in three or greater rows. For example, in the example shown in FIG. 5, a first sub-array 15 is disposed on the main surface of the insulating substrate 30, and a second sub-array 21 and a third sub-array 22 are disposed with the first sub-array 15 therebetween in the vertical direction. The first sub-array 15 is shifted relative to each of the second sub-array 21 and the third sub-array 22 in the long-side direction, that is, the satellite orbital direction 60, by one half of the pitch d. The number of antenna elements 1 included in the first sub-array 15 and the total number of antenna elements 1 included in the second sub-array 21 and the third sub-array 22 are preferably set to be the same. Moreover, the structure of the sub-arrays shown in FIG. 5 is equivalent to an example where a sub-array of four rows and 12 columns is divided into two divided sub-arrays, the divided sub-arrays being disposed with the first sub-array 15 of four rows and 12 columns therebetween in the vertical direction.

Figure 6:
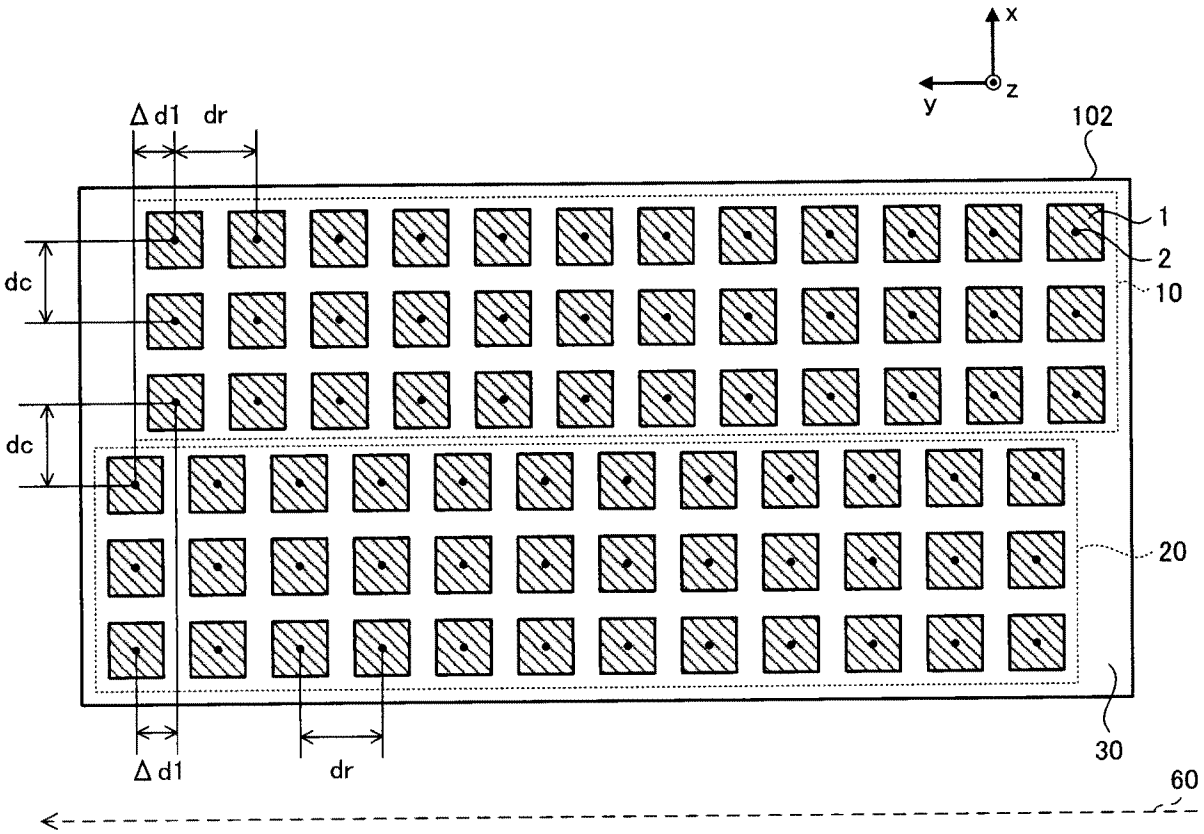
FIG. 6 is a diagram illustrating another modification of the array antenna for satellite communications according to Embodiment 1.

In the present embodiment, an example where the antenna elements 1 are arrayed with the pitch d, both in the row direction and in the column direction, is described. However, as exemplified in FIG. 6, the pitch dr in the row direction, that is, the satellite orbital direction 60, and the pitch dc in the column direction, that is, a direction orthogonal to the satellite orbital direction 60, may be different from each other. Also, the number of antenna elements 1 included in each sub-array is not limited to the number of the antenna elements 1 included in each of the array antenna 101 and the array antenna 102 shown in FIGS. 5 and 6, respectively, and any number of antenna elements 1 may be used.

Embodiment 2

Figure 7:
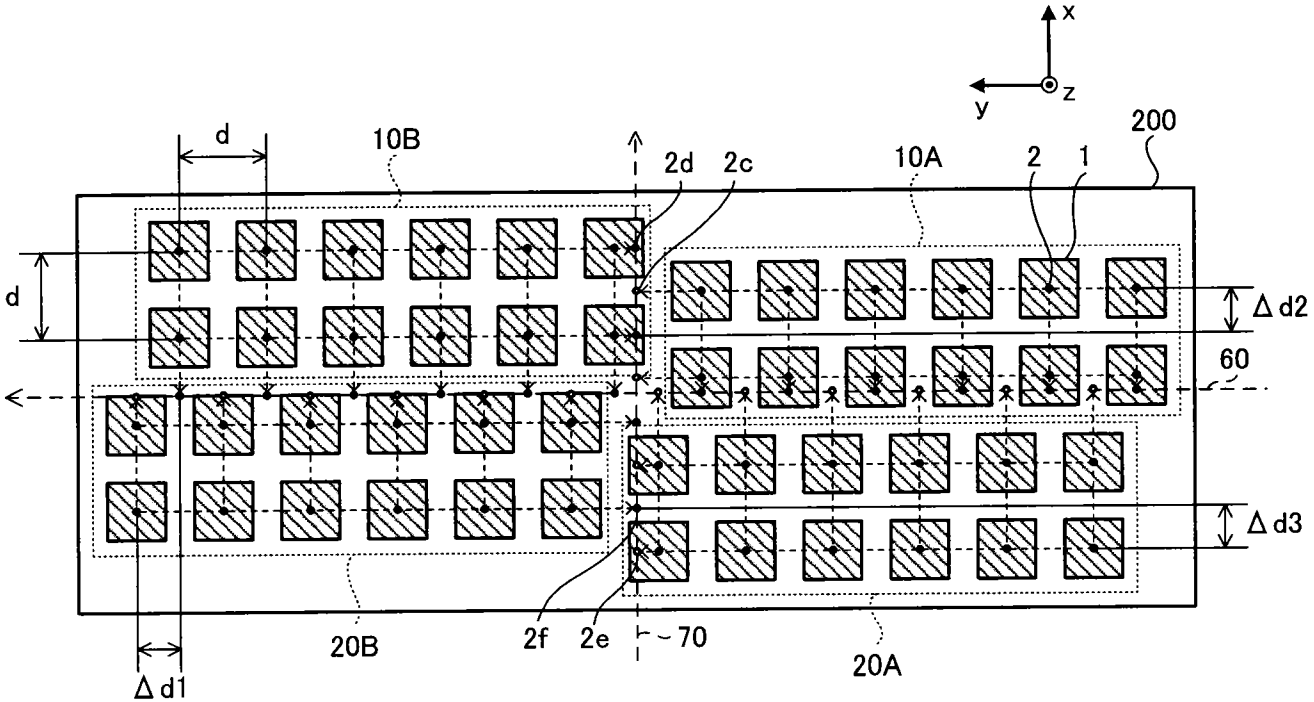
FIG. 7 is a diagram illustrating an arrangement of sub-arrays of an array antenna for satellite communication according to Embodiment 2 of the present disclosure.

FIG. 7 is a diagram illustrating an arrangement of sub-arrays of an array antenna for satellite communications 200 (hereinafter referred to as "array antenna 200") according to Embodiment 2 of the present disclosure. Similar to the array antenna 100 according to Embodiment 1, the array antenna 200 includes an insulating substrate 30 and antenna elements 1 disposed on a main surface of the insulating substrate 30. To facilitate distinguishing between the antenna elements 1 and the insulating substrate 30, the antenna elements 1 are hatched. The relationship between each coordinate axis of the xyz orthogonal coordinate system shown in FIG. 7 and the array antenna 200 or the like is similar to that of Embodiment 1, and thus such relationship is not described herein.

As shown in FIG. 7, the array antenna 200 according to Embodiment 2 is designed such that a first sub-array 10 and a second sub-array 20 are shifted relative to each other in a satellite orbital direction 60 as described in Embodiment 1 above. Additionally, the first sub-array 10 and the second sub-array 20 are each divided by a plane orthogonal to a satellite orbital direction 60, and the divided sub arrays are shifted relative to each other in a direction 70 orthogonal to the satellite orbital direction 60. Specifically, the first sub-array 10 and the second sub-array 20 are divided into a first divided sub-array 10A and a second divided sub-array 10B, and a third divided sub-array 20A and a fourth divided sub-array 20B, respectively, by the plane orthogonal to the satellite orbital direction 60. The first divided sub-array 10A and the second divided sub-array 10B are shifted relative to each other by one half of the pitch d in the x-axis direction, and the third divided sub-array 20A and the fourth divided sub-array 20B are shifted relative to each other by one half of the pitch d in the x-axis direction. Due to this arrangement, an interval Δd2 between a projection point 2*c*, obtained when projecting the phase center 2 of each antenna element 1 included in the first divided sub-array 10A perpendicularly onto a plane orthogonal to a satellite orbital plane, and a projection point 2*d*, obtained when projecting the phase center 2 of each antenna element 1 included in the second divided sub-array 10B perpendicularly onto the plane orthogonal to the satellite orbital plane, is one half of the pitch d. Similarly, an interval Δd3 between a projection point 2*e*, obtained when projecting the phase center 2 of each antenna element 1 included in the third divided sub-array 20A perpendicularly onto the plane orthogonal to the satellite orbital plane, and a projection point 2*f*, obtained when projecting the phase center 2 of each antenna element 1 included in the fourth divided sub-array 20B perpendicularly onto the plane orthogonal to the satellite orbital plane, is one half of the pitch d. Thus, the projection points of the phase centers 2 of the antenna elements 1 in the array antenna 200 according to Embodiment 2 are positioned densely in the direction 70 orthogonal to the satellite orbital direction 60, as compared with those in an array antenna including sub-arrays that are not shifted relative to each other. Thus, the side-lobe level in the plane orthogonal to the satellite orbital direction 60 is low.

As described above, the array antenna 200 according to Embodiment 2 is designed such that the first sub-array 10 and the second sub-array 20 are shifted relative to each other in the satellite orbital direction 60, and also such that the first divided sub-array 10A and the second divided sub-array 10B are shifted relative to each other in the direction 70 orthogonal to the satellite orbital direction 60, and the third divided sub-array 20A and the fourth divided sub-array 20B are shifted relative to each other in the direction 70 orthogonal to the satellite orbital direction 60. This arrangement offers the effect of a low side-lobe level in the plane orthogonal to the satellite orbital direction 60, in addition to the effect provided by the array antenna 100 according to Embodiment 1.

Moreover, the array antenna 200 according to Embodiment 2 is designed such that the positional difference between the divided sub-arrays, divided from the same sub-array, is set to be one half of the pitch d. This arrangement enables an extremely low side-lobe level in the plane orthogonal to the satellite orbital direction 60.

The array antenna 200 according to Embodiment 2 can be recognized as an array antenna having two sub-arrays that are arranged to be adjacent to each other in a short-side direction and to be shifted relative to each other in a long-side direction, and also having additional two sub-arrays. Under such recognition, the first divided sub-array 10A, for example, is a first sub-array, and the third divided sub-array 20A is a second sub-array. And, the second divided sub-array 10B is a third sub-array, and the fourth divided sub-array 20B is a fourth sub-array. As shown in FIG. 7, the third sub-array, that is, the second divided sub-array 10B, and the fourth sub-array, that is, the fourth divided sub-array 20B, are arranged to be adjacent to each other in a short-side direction and to be shifted relative to each other in a long-side direction. The third sub-array, that is, the second divided sub-array 10B, is arranged to be adjacent to the first sub-array, that is, the first divided sub-array 10A, in the long-side direction and to be shifted relative to the first sub-array in the short-side direction. The fourth sub-array, that is, the fourth divided sub-array 20B, is arranged to be adjacent to the second sub-array, that is, the third divided sub-array 20A, in the long-side direction and to be shifted relative to the second sub-array in the short-side direction.

In the foregoing Embodiment 1, it is indicated that the side-lobe level in the satellite orbital plane is extremely low when the positional difference between the first sub-array 10 and the second sub-array 20 is one half of the pitch d. Furthermore, in the foregoing Embodiment 2, it is indicated that the side-lobe level in the plane orthogonal to the satellite orbital direction 60 is extremely low because the positional difference between the divided sub-arrays, divided from the same sub-array, is set to be one half of the pitch d. However, the positional difference between the sub-arrays may be substantially one half of the pitch d; for example, the positional difference may be 80 to 120% of one half of the pitch d, so long as similar effects can be obtained.

In the foregoing embodiments, transmission properties of the array antenna 100 according to Embodiment 1 and the array antenna 200 according to Embodiment 2 are mainly discussed. These array antennas also exhibit excellent properties in receiving operations.

The foregoing describes some example embodiments for explanatory purposes. Although the foregoing discussion has presented specific embodiments, persons skilled in the art will recognize that changes may be made in form and detail without departing from the broader spirit and scope of the disclosure. Accordingly, the specification and drawings are to be regarded in an illustrative rather than a restrictive sense. This detailed description, therefore, is not to be taken in a limiting sense, and the scope of the disclosure is defined only by the included claims, along with the full range of equivalents to which such claims are entitled.

What is claimed is:

1. An antenna comprising:

a substrate;

a first sub-array comprising a plurality of antenna elements arrayed on the substrate in a matrix that includes at least two rows and at least two columns;

a second sub-array comprising a plurality of antenna elements arrayed on the substrate in a matrix that includes at least two rows and at least two columns;

a third sub-array comprising a plurality of antenna elements arrayed in a matrix on the substrate;

a fourth sub-array comprising a plurality of antenna elements arrayed in a matrix on the substrate; and a plurality of power-supply lines configured to supply power to the plurality of antenna elements of the first sub-array and to the plurality of antenna elements of the second sub-array, every power-supply line connected to an antenna element in the first sub-array having a same length and every power-supply line connected to an antenna element in the second sub-array having a same length, wherein the first sub-array and the second sub-array are arranged to be adjacent to each other in a short-side direction and to be shifted relative to each other in a long-side direction so that the at least two columns of the matrix of the second sub-array are shifted with respect to the at least two columns of the matrix of the first sub-array, a pitch in the short-side direction between all antenna elements in the first sub-array that are adjacent to the second sub-array and all antenna elements in the second sub-array that are adjacent to the first sub-array is the same as a pitch in the short-side direction between adjacent elements in the first sub-array and a pitch in the short-side direction between adjacent elements in the second sub-array, the third sub-array and the fourth sub-array are arranged to be adjacent to each other in a short-side direction and to be shifted relative to each other in a long-side direction, the third sub-array is arranged to be adjacent to the first sub-array in the long-side direction and to be shifted relative to the first sub-array in the short-side direction, and the fourth sub-array is arranged to be adjacent to the second sub-array in the long-side direction and to be shifted relative to the second sub-array in the short-side direction.

2. The antenna according to claim 1, wherein a positional difference between the first sub-array and the second sub-array is substantially one half of a pitch of the antenna elements in the long-side direction.

3. The antenna according to claim 1, wherein a positional difference between the first sub-array and the third sub-array and a positional difference between the second sub-array and the fourth sub-array are each substantially one half of a pitch of the antenna elements in the short-side direction.

4. The antenna according to claim 1, wherein the matrix of the first sub-array includes two rows and twelve columns, and the matrix of the second sub-array includes two rows and twelve columns.

5. The antenna according to claim 1, wherein a pitch in the short-side direction between an antenna element in the third sub-array and an antenna element in the fourth sub-array that is adjacent to the antenna element in the third sub-array is the same as a pitch in the short-side direction between adjacent elements in the third sub-array and a pitch in the short-side direction between adjacent elements in the fourth sub-array.

6. The antenna according to claim 1, wherein the antenna elements of the first sub-array and the antenna elements of the second sub-array are square antenna elements.

* * * * *